US011135853B1

(12) United States Patent
Yu

(10) Patent No.: US 11,135,853 B1
(45) Date of Patent: Oct. 5, 2021

(54) INK CIRCULATION SUPPLY SYSTEM AND METHOD FOR INKJET HEAD

(71) Applicant: Gosantech Co., Ltd., Cheonan-si (KR)

(72) Inventor: Jaeryul Yu, Cheonan-si (KR)

(73) Assignee: GOSANTECH CO., LTD., Cheonan-si (KR)

( * ) Notice: Subject to any disclaimer, the term of this patent is extended or adjusted under 35 U.S.C. 154(b) by 0 days.

(21) Appl. No.: 16/908,146

(22) Filed: Jun. 22, 2020

(30) Foreign Application Priority Data

Mar. 13, 2020 (KR) ..... 10-2020-0031085

(51) Int. Cl.
*B41J 2/175* (2006.01)

(52) U.S. Cl.
CPC ..... *B41J 2/17596* (2013.01); *B41J 2/175* (2013.01); *B41J 2/17513* (2013.01); *B41J 2/17556* (2013.01)

(58) Field of Classification Search
CPC .... B41J 2/175; B41J 2/17513; B41J 2/17556; B41J 2/17596
USPC ..... 347/84, 85, 89
See application file for complete search history.

(56) References Cited

U.S. PATENT DOCUMENTS 8,789,933 B2 * 7/2014 Igarashi ..... B41J 2/175 347/85
10,124,597 B2 * 11/2018 Alessi ..... B41J 2/175
10,752,012 B2 * 8/2020 Lee ..... B41J 2/18
2009/0284563 A1 * 11/2009 Bansyo ..... B41J 2/18 347/19

FOREIGN PATENT DOCUMENTS

| | | | |
|---|---|---|---|
| JP | 2009101516 | A | 5/2009 |
| JP | 2009274386 | A | 11/2009 |
| JP | 2018043518 | A | 3/2018 |
| KR | 10-1989375 | B1 | 6/2019 |

OTHER PUBLICATIONS

Registration Decision issued for KR patent application serial No. 10-2020-0031085, dated Dec. 14, 2020, with machine translation.

* cited by examiner

*Primary Examiner* — An H Do
(74) *Attorney, Agent, or Firm* — Westman, Champlin & Koehler, P.A.; Amanda M. Prose

(57) ABSTRACT

The present invention relates to an ink circulation supply system for an inkjet head. The system is configured to supply ink to the inkjet head having a plurality of nozzles for ejecting the ink, and includes: a meniscus reservoir; a circulation reservoir; and an ante reservoir, the reservoirs where a first pressure connection pipe with a first pressure valve, a second pressure connection pipe with a second pressure valve, a first ink connection pipe, and a second ink connection pipe with an ink valve are provided, wherein when the internal pressure of the circulation reservoir is controlled to be lower than that of the meniscus reservoir, the ink stored in the meniscus reservoir is moved to the circulation reservoir without requiring use of a separate pump.

10 Claims, 13 Drawing Sheets

INK CIRCULATION SUPPLY SYSTEM AND METHOD FOR INKJET HEAD

CROSS REFERENCE TO RELATED APPLICATION

The present application claims priority to Korean Patent Application No. 10-2020-0031085, filed Mar. 13, 2020, the entire contents of which is incorporated herein for all purposes by this reference.

BACKGROUND OF THE INVENTION

Field of the Invention

The present invention relates generally to an ink circulation supply system for circulating ink in a head of an inkjet printer. More particularly, the present invention relates to an ink circulation supply system capable of circulating ink without requiring use of a separate pump in an inkjet printer used in an industrial field.

Description of the Related Art

In general, inkjet printing in which liquid ink is jetted onto a surface of a medium in a droplet form according to a shape signal is used not only as a printing method for creating a document or a flyer, but also used in a solution process in the semiconductor and display fields.

Inkjet printing, which can form patterns of complex shapes on a substrate or eject ink accurately only at specific positions, has become increasingly used for a variety of applications. While small-sized inkjet printers for document creation have a structure in which ink is stored in an inkjet head that ejects ink droplets, large-sized document printers or industrial inkjet printers consume large amounts of ink and thus has a structure in which a reservoir for storing ink and an inkjet head are separated.

FIG. 13 is a schematic view illustrating the structure of a typical industrial inkjet printer.

The typical industrial inkjet printer includes an inkjet head 10, a head supply reservoir 20, a pressure controller 30, a buffer reservoir 40, and an ink reservoir tank 50.

The inkjet head 10 includes nozzles that eject ink and is configured to selectively eject ink at a required position to perform printing. The head supply reservoir 20 is a space for storing ink to be supplied to the inkjet head 10 and is configured to be continuously supplied with ink through a supply passage 11 connected to the head supply reservoir 20. The ink may be supplied only in one direction toward the inkjet head 10 from the head supply reservoir 20. However, it is common for the industrial inkjet printer to have a recovery passage 12 for returning ink remaining in the inkjet head 10 back to the head supply reservoir 20 in order to accurately control an ejection amount. The pressure controller 30 is configured to control the pressures of the inkjet head 10 and the head supply reservoir 20 for accurate ejection of ink, and a pressure control pipe 31 is connected to the head supply reservoir 20. Due to the fact that the industrial inkjet printer consumes a large amount of ink, ink has to be continuously supplied to the head supply reservoir 20. However, it is common that ink stored in the ink reservoir tank 50 located externally of the printer is additionally supplied to the head supply reservoir 20 via the buffer reservoir 40 rather than supplying ink directly to the head supply reservoir 20. In this case, ink to be additionally supplied is moved in one direction from the ink reservoir tank 50 toward the buffer reservoir 40.

In order to eject a correct amount of ink in an inkjet printing process, it is necessary for ink, which is ready to be ejected from the inkjet head, to maintain a meniscus state in which the surface of ink is curved inward with respect to a nozzle inlet by capillary action. To this end, it is common that the position of the head supply reservoir is higher than that of the inkjet head, and the inside of the head supply reservoir is maintained in a vacuum to generate a negative pressure in the head supply reservoir, thereby maintaining the meniscus state by preventing ink from flowing out of the inkjet head. However, if the head supply reservoir is maintained in a vacuum, evaporation of a solvent constituting ink is accelerated to change properties of ink, and the most problematic aspect is that viscosity of ink increases over time. The increased viscosity of ink may result in difficulty in effective jetting of ink from the inkjet head.

Further, in recent years, as application fields of inkjet printers have become wider, attempts to use ink in which particles are dispersed have increased, such as employing ink in which metal particles are dispersed for an electrode pattern, and there has been also attempts to employ ink in which a flat panel display material or organic light-emitting diode (OLED) material is dispersed. However, inkjet printing has not been employed in the aforementioned cases due to a problem in which dispersibility of ink is lowered, such as when the metal particles, the flat panel display material, or the OLED material sinks, due to their own weight in a state in which ink is stored in the head supply reservoir.

In an effort to solve this, a technology to circulate ink inside an inkjet printer using a piezoelectric pump so as to maintain a meniscus state has been developed (Korean Patent No. 10-1989375).

In this case, however, in the process in which ink including metal particles, a flat panel display material, or an OLED material passes the pump, a problem such as malfunction in the pump or shortening of life span of the pump may occur.

The foregoing is intended merely to aid in the understanding of the background of the present invention, and is not intended to mean that the present invention falls within the purview of the related art that is already known to those skilled in the art.

SUMMARY OF THE INVENTION

Accordingly, the present invention has been made keeping in mind the above problems occurring in the related art, and an objective of the present invention is to provide an ink circulation supply system that does not require use of a pump in the process of circulating ink between an inkjet head and a head supply reservoir, in order to maintain viscosity of ink or to maintain dispersibility and homogeneity of particles dispersed in ink.

In order to achieve the above objective, according to one aspect of the present invention, there is provided an ink circulation supply system for an inkjet head, the system being configured to supply ink to the inkjet head having a plurality of nozzles for ejecting the ink, the system including: a meniscus reservoir connected to the inkjet head through a supply passage, and configured to transfer the ink to the inkjet head; a circulation reservoir connected to the inkjet head through a recovery passage, and configured such that the ink recovered from the inkjet head is returned thereto; an ante reservoir connected to the circulation reservoir through a first pressure connection pipe connected to an upper portion of the ante reservoir, connected to the meniscus reservoir through a second pressure connection pipe connected to the upper portion of the ante reservoir, connected to the circulation reservoir through a first ink connection pipe connected to a lower portion of the ante reservoir, and connected to the meniscus reservoir through a second ink connection pipe connected to the lower portion of the ante reservoir; a first pressure controller connected to the meniscus reservoir through a first pressure control pipe, and configured to control internal pressure; and a second pressure controller connected to the circulation reservoir through a second pressure control pipe, and configured to control internal pressure, wherein a first pressure valve may be provided in the first pressure connection pipe, a second pressure valve may be provided in the second pressure connection pipe, and an ink valve may be provided in the second ink connection pipe.

Due to the fact that an industrial inkjet printer continuously performs a printing process, the printer is provided with a head supply reservoir for supplying ink to the inkjet head and an ink reservoir tank provided externally for supplying ink to the head supply reservoir. Here, supply of ink from the head supply reservoir to the inkjet head is expressed as internal supply or local ink supply, and supply of ink to the head supply reservoir directly from the ink reservoir tank or via a buffer reservoir is expressed as external supply or bulk ink supply. The present invention is a technique for circulating ink in an internal supply process in which ink is supplied to the inkjet head from the head supply reservoir.

In the present invention, apart from supplying ink to eject ink from the inkjet head, ink is circulated between the inkjet head and an ink reservoir, whereby ink is moved without stagnation, thereby maintaining dispersibility and homogeneity of ink. In this case, due to the fact that the present invention does not require use a pump to circulate ink between the inkjet head and the ink reservoir, a meniscus state of the ink reservoir and/or inkjet head is maintained by pulsation of the pump, and further, the problem of malfunction of the pump due to metal particles, a flat panel display material, or an OLED material does not occur.

In detail, the present invention is characterized in that spaces in which the ink is stored are separated, and ink is circulated due to a pressure difference between a portion where ink is supplied toward the inkjet head and a portion where ink recovered via the inkjet head, without requiring use of the pump. In this case, the portion where ink is supplied toward the inkjet head has to maintain a constant negative pressure to maintain the meniscus state, and thus the meniscus state of the inkjet head is maintained by positioning the ante reservoir between the meniscus reservoir and the circulation reservoir.

A flow sensor for measuring a flow rate of the ink may be provided in at least one of the supply passage and the recovery passage.

The system may further include an ink reservoir tank provided externally and configured to store the ink, wherein the ink may be additionally injected into one of the meniscus reservoir, the circulation reservoir, and the ante reservoir through a first injection pipe connected to the ink reservoir tank.

The system may further include: an ink reservoir tank provided externally and configured to store the ink; and a buffer reservoir configured to temporarily store the ink, wherein the ink may be additionally injected into one of the meniscus reservoir, the circulation reservoir, and the ante reservoir through a second injection pipe connected to the buffer reservoir, and the ink may be circulated between the buffer reservoir and the ink reservoir tank through two transport pipes connected to the buffer reservoir and the ink reservoir tank at positions therebetween.

According to another aspect of the present invention, there is provided an ink circulation supply method for an inkjet head, the method being circulating ink in the inkjet head without requiring use of a pump in the system having the above-described structure, wherein an internal pressure of the circulation reservoir may be controlled to be lower than an internal pressure of the meniscus reservoir, whereby the ink stored in the meniscus reservoir may be moved to the circulation reservoir via the inkjet head.

In detail, the internal pressure of the circulation reservoir may be controlled to be lower than the internal pressure of the meniscus reservoir, and the first pressure valve, the second pressure valve, and the ink valve may all remain closed, whereby the ink stored in the meniscus reservoir may be moved to the circulation reservoir via the inkjet head.

In this case, the internal pressure of the circulation reservoir may be controlled to change a difference between the internal pressure of the meniscus reservoir and the internal pressure of the circulation reservoir, whereby a flow rate at which the ink stored in the meniscus reservoir may be moved to the circulation reservoir via the inkjet head may be controlled. The internal pressure of the circulation reservoir may be controlled on the basis of the flow rate measured by the flow sensor provided in the supply passage or the recovery passage.

When a predetermined amount of the ink stored in the meniscus reservoir is moved to the circulation reservoir via the inkjet head, the first pressure valve may be opened, causing an internal pressure of the ante reservoir to match with the internal pressure of the circulation reservoir, and causing the ink stored in the circulation reservoir to be moved to the ante reservoir due to a difference in head pressure between the ink stored in the ante reservoir and the ink stored in the circulation reservoir.

When a predetermined amount of the ink stored in the circulation reservoir is moved to the ante reservoir, the first pressure valve may be closed and the second pressure valve may be opened, causing the internal pressure of the ante reservoir to match with the internal pressure of the circulation reservoir; and the ink valve may be opened, causing the ink stored in the ante reservoir to be moved to the meniscus reservoir due to a difference in head pressure between the ink stored in the ante reservoir and the ink stored in the meniscus reservoir The present invention as described above enables circulation of ink between the inkjet head and the ink reservoir without requiring use of a pump, and thus there is an effect of maintaining fluidity, dispersibility, and homogeneity of ink, while not causing the problem due to malfunction of the pump.

Further, the present invention provides increased fluidity, dispersibility, and homogeneity of ink, and thus there is an excellent effect that the inkjet head can be supplied with ink having fluidity, dispersibility, and homogeneity maintained.

Furthermore, the inkjet printing process using ink in which metal particles, a flat panel display material, or an OLED material is dispersed can be employed in a product manufacturing process, and thus there is an effect in that the manufacturing process of the product can be accurate and easy.

BRIEF DESCRIPTION OF THE DRAWINGS

The above and other objectives, features, and other advantages of the present invention will be more clearly understood from the following detailed description when taken in conjunction with the accompanying drawings, in which.

DETAILED DESCRIPTION OF THE INVENTION

Exemplary embodiments according to the present invention will be described in detail with reference to the accompanying drawings.

The description of the disclosed technology is only an example for structural and functional illustration, and thus the scope of the disclosure should not be construed as being limited by the embodiments described herein. That is, it should be understood that the embodiments of the present disclosure can be variously modified in many different forms, and thus the scope of the disclosure includes equivalents by which the technical spirit of the disclosure can be accomplished.

The terms used herein should be understood as follows.

It will be understood that, although the terms first, second, etc. may be used herein to describe various elements, the scope of the disclosure should not be limited by these terms. These terms are only used to distinguish one element, from another element. For example, a first element discussed below could be termed a second element without departing from the teachings of the present invention. Similarly, the second element could also be termed the first element.

Figure 1:
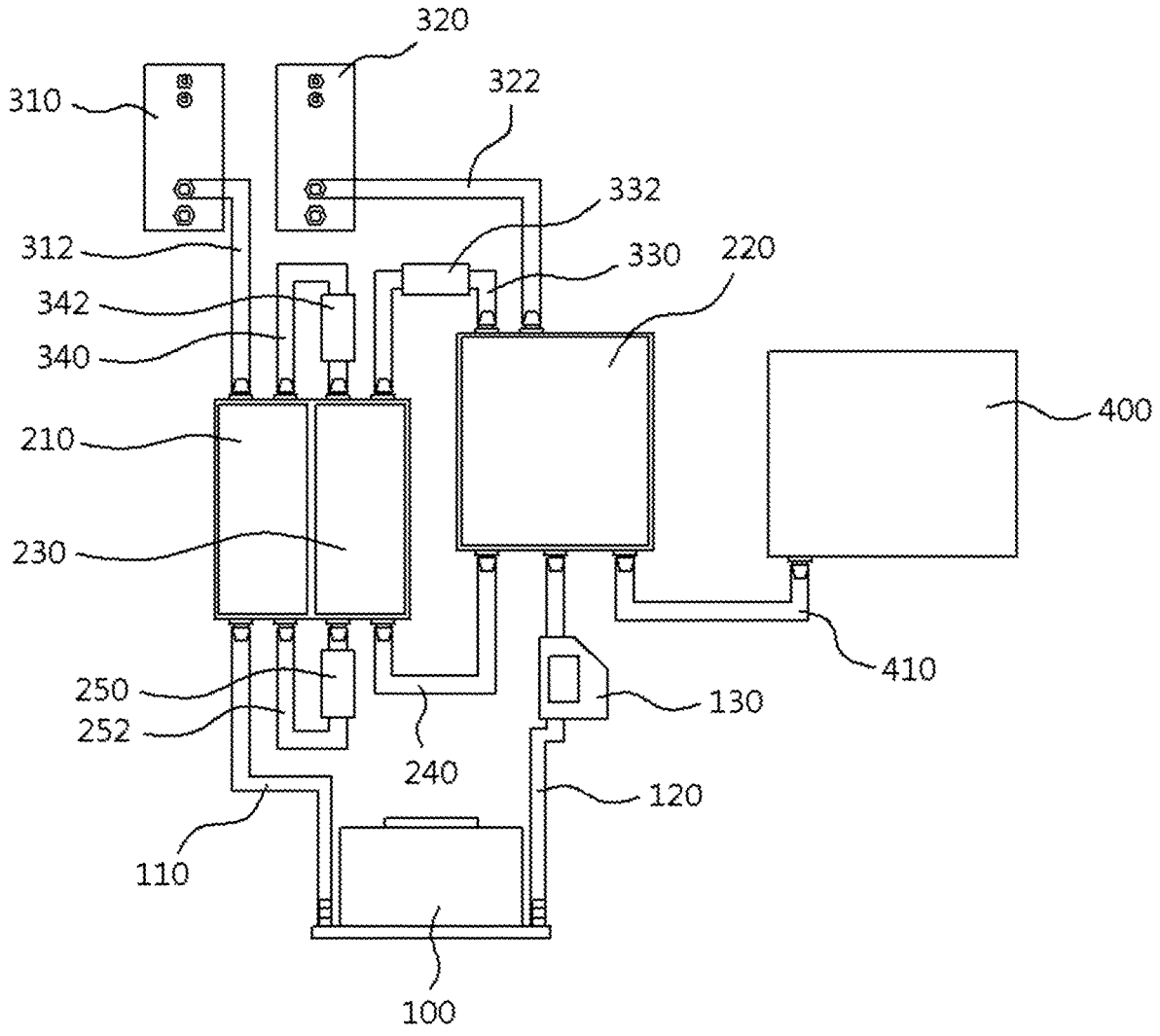
FIG. 1 is a view illustrating a structure of an ink circulation supply system for an inkjet head according to an embodiment of the present invention.

FIG. 1 is a view illustrating a structure of an ink circulation supply system for an inkjet head according to an embodiment of the present invention.

As illustrated, the ink circulation supply system of the present embodiment includes an inkjet head 100 and three reservoirs 210, 220, and 230, and two pressure controllers 310 and 320.

The inkjet head 100 is a part having a plurality of nozzles for ejecting ink, and an inkjet printer including the ink circulation supply system of the present embodiment is configured for industrial use and has a structure in which the inkjet head 100 and a head supply reservoir for storing ink to be supplied to the inkjet head 100 are separated. The technical configuration of an inkjet head, which has been used in the related art, can be employed within a range that does not impair the features of the present invention, and can also be employed in various modifications.

The head supply reservoir is a part for storing ink inside the inkjet printer to provide ink to the inkjet head 100. In the related art, a head supply reservoir is generally composed of a single space, but in the present invention, the head supply reservoir is divided into the three reservoirs 210, 220, and 230, each of which is provided with a separate space. Hereinafter, when describing a unique configuration and function of each of the reservoirs, description will be given using the name of each of the reservoirs, but when the three reservoirs collectively perform the same function as the head supply reservoir according to the related art, the reservoirs will be referred to as the head supply reservoir.

A first reservoir is a meniscus reservoir 210.

The meniscus reservoir 210 is connected to a supply passage 110 for supplying ink to the inkjet head 100, and is connected to a first pressure controller 310 located upstream of the meniscus reservoir 210, through a first pressure control pipe 312. Because the meniscus reservoir 210 is connected to the inkjet head 100 through the supply passage 110, the control of the internal pressure of the meniscus reservoir 210 is necessary so that the inkjet head 100 maintains a meniscus state.

A second reservoir is a circulation reservoir 220.

The circulation reservoir 220 is connected to a recovery passage 120 for returning ink remaining in the inkjet head 100 to the head supply reservoir, and is connected to a second pressure controller 320 located upstream of the circulation reservoir 220, through a second pressure control pipe 322. The circulation reservoir 220 is not related to maintaining the meniscus state, but is configured to form a pressure difference between the circulation reservoir 220 and the meniscus reservoir 210, thereby causing ink of the meniscus reservoir 210 to be moved for circulation to the circulation reservoir 220 via the inkjet head 100.

A third reservoir is an ante reservoir 230.

The ante reservoir 230 is provided to move ink of the circulation reservoir 220 back to the meniscus reservoir 210, the ink resulting from ink of the meniscus reservoir 210 being moved to the circulation reservoir 220 via the inkjet head 100 and collected in the circulation reservoir 220 due to the pressure difference between the meniscus reservoir 210 and the circulation reservoir 220.

The ante reservoir 230 is connected to the circulation reservoir 220 through a first pressure connection pipe 330 provided at an upper portion of the ante reservoir 230 and connected to the meniscus reservoir 210 through a second pressure connection pipe 340 provided at the upper portion of the ante reservoir 230. Further, the ante reservoir 230 is connected to the circulation reservoir 220 through a first ink connection pipe 240 provided at a lower portion of the ante reservoir 230 and connected to the meniscus reservoir 210 through a second ink connection pipe 252 provided at the lower portion of the ante reservoir 230.

A first pressure valve 332 is provided in the first pressure connection pipe 330, a second pressure valve 342 is provided in the second pressure connection pipe 340, and an ink valve 250 is provided in the second ink connection pipe 252.

The first pressure valve 332, the second pressure valve 342, and the ink valve 250 are configured to be properly opened and closed to control movement of ink so that ink of the meniscus reservoir 210 is moved to the circulation reservoir 220 via the inkjet head 100 or ink of the circulation reservoir 220 is moved to the meniscus reservoir 210 via the ante reservoir 230. A detailed operation will be described later.

As described above, due to the fact that the present invention is a configuration in which ink exiting from the meniscus reservoir 210 is recovered to the circulation reservoir 220 via the inkjet head 100, the three reservoirs are combined and function as an existing head supply reservoir, and each of the three reservoirs 210, 220, and 230 is a different component from an existing buffer reservoir or an existing ink reservoir tank provided externally.

In FIG. 1, a configuration in which ink is injected from an ink reservoir tank 400 to the circulation reservoir 220 through a first injection pipe 410 is illustrated. However, the circulation reservoir 220 as described above is a component different from the buffer reservoir provided in the middle of the path for injecting ink into the head supply reservoir in that ink remaining in the inkjet head 100 is recovered through the recovery passage 120. Further, the first injection pipe 410 connected to the ink reservoir tank 400 may be connected to the meniscus reservoir 210 or the ante reservoir 230 as necessary.

An existing pressure controller is configured to control ink inside the inkjet head 100 to maintain the meniscus state by controlling the pressure of the head supply reservoir, and a single pressure controller is generally provided. Due to the fact that the ink circulation supply system according to the present invention is configured to circulate ink by means of a pressure difference between division reservoirs, in addition to pressure control for maintaining the meniscus state, the two pressure controllers 310 and 320 are provided.

The first pressure controller 310 is connected to the meniscus reservoir 210 through the first pressure control pipe 312, and is configured to control the pressure of the meniscus reservoir 210 in the same manner as the existing pressure controller to enable the inkjet head 100 to maintain the meniscus state. Due to the fact that first pressure controller 310 employs a general structure separately connected to the meniscus reservoir 210 which is one constituting the head supply reservoir, pressure control devices, which have been conventionally used to maintain the meniscus state in inkjet printers, may be employed without modification.

The second pressure controller 320 is connected to the circulation reservoir 220 through the second pressure control pipe 322, and is configured to perform a function of forming the pressure difference between the circulation reservoir 220 and the meniscus reservoir 210.

In order for ink exiting from the meniscus reservoir 210 to be moved to the circulation reservoir 220 via the inkjet head 100, the internal pressure of the circulation reservoir 220 has to be lower than that of the meniscus reservoir 210. Controlling the internal pressure of the reservoir is the same as in the related art, except that the internal pressure of the circulation reservoir 220 is controlled to be lower than that of the meniscus reservoir 210, and thus pressure control devices conventionally used in inkjet printers may be employed.

On the other hand, as will be described later in detail, in order to maintain the meniscus state of the meniscus reservoir 210, the first pressure controller 310 is operated to maintain a constant internal pressure of the meniscus reservoir 210. On the other hand, in order to control the flow rate of ink, it is necessary to control the internal pressure of the circulation reservoir 220. Thus, the second pressure controller 320 is preferably configured to actively control the internal pressure of the circulation reservoir 220.

In the present embodiment, a flow sensor 130 is provided in the recovery passage 120 and is configured to measure the flow rate of ink exiting from the meniscus reservoir 210 to the circulation reservoir 220 via the inkjet head 100. The second pressure controller 320 controls the internal pressure of the circulation reservoir 220 so that a target flow rate is reached on the basis of the measured flow rate of ink. In detail, when the flow rate of ink exiting from the meniscus reservoir 210 and moved to the circulation reservoir 220 via the inkjet head 100 is less than the target flow rate, the pressure difference between the meniscus reservoir 210 and the circulation reservoir 220 is controlled to increase by further decreasing the internal pressure of the circulation reservoir 220. On the other hand, when the flow rate of ink exiting from the meniscus reservoir 210 and moved to the circulation reservoir 220 via the inkjet head 100 is greater than the target flow rate, the pressure difference between the meniscus reservoir 210 and the circulation reservoir 220 is controlled to decrease by increasing the internal pressure of the circulation reservoir 220.

Hereinafter, a specific operation of the ink circulation supply system for the inkjet head according to the embodiment illustrated in FIG. 1 will be described.

Figure 2:
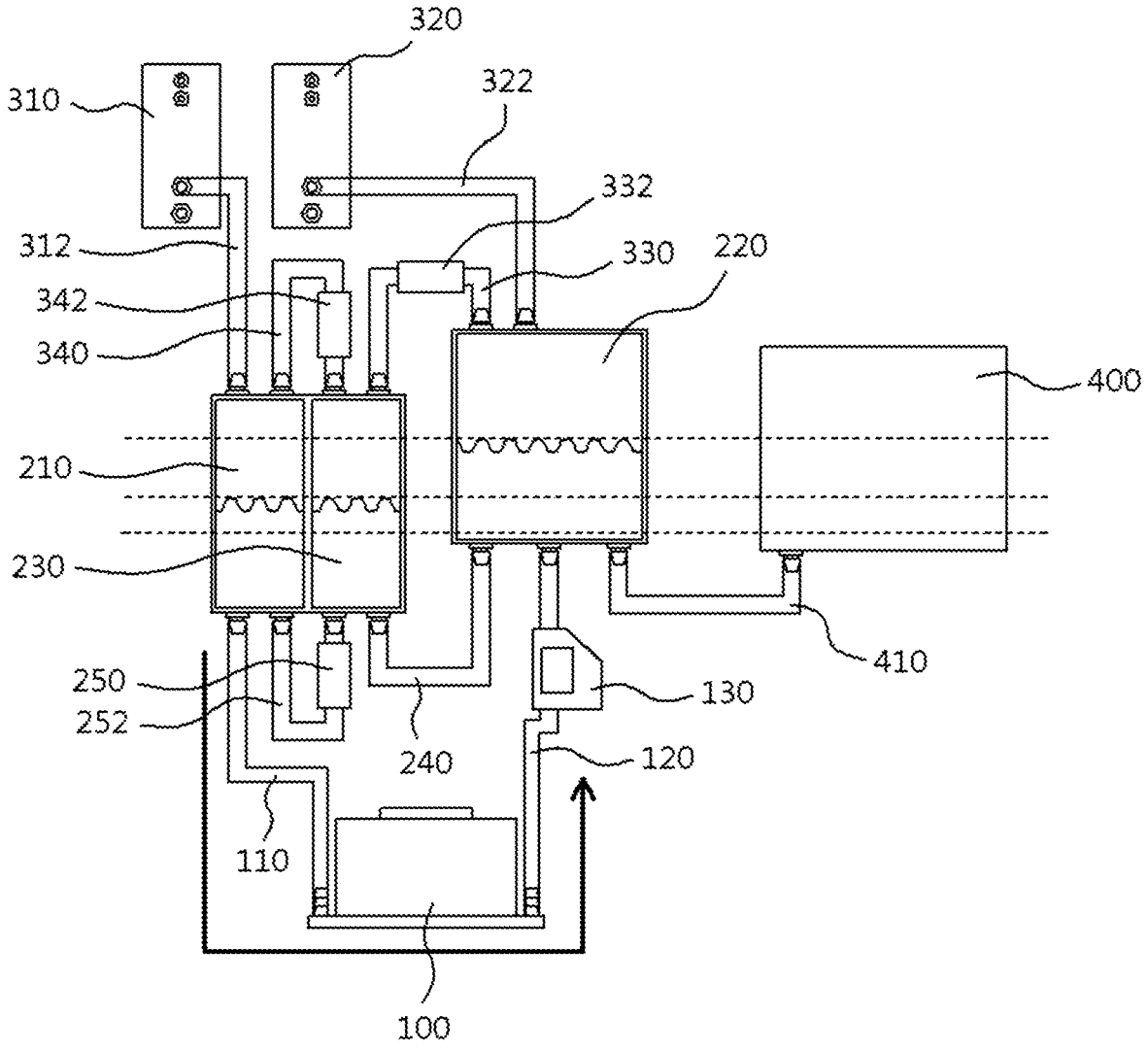
FIGS. 2 to 4 are views illustrating an operation of the ink circulation supply system for the inkjet head according to the embodiment of the present invention.
Figure 3:
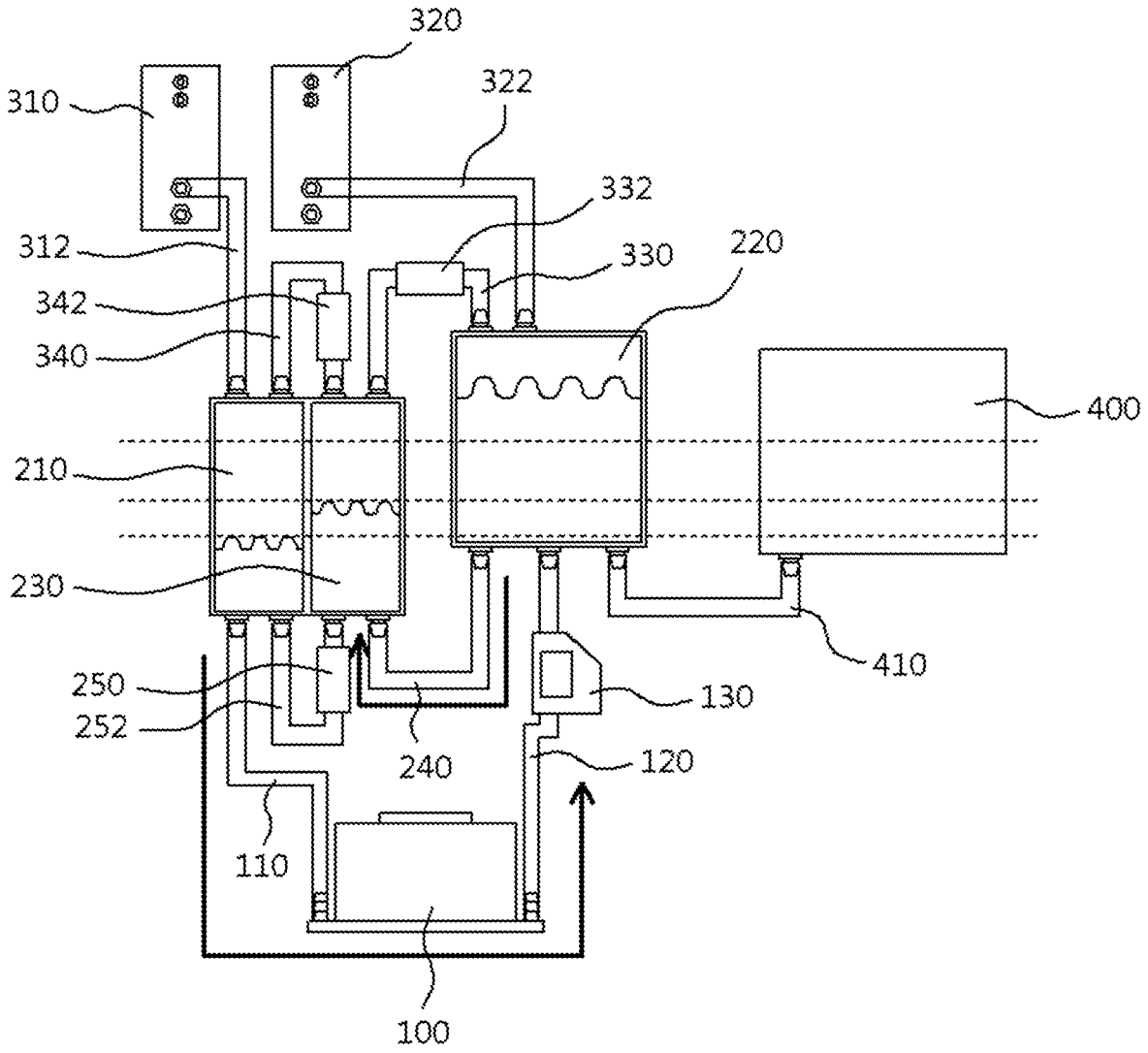
Figure 4:
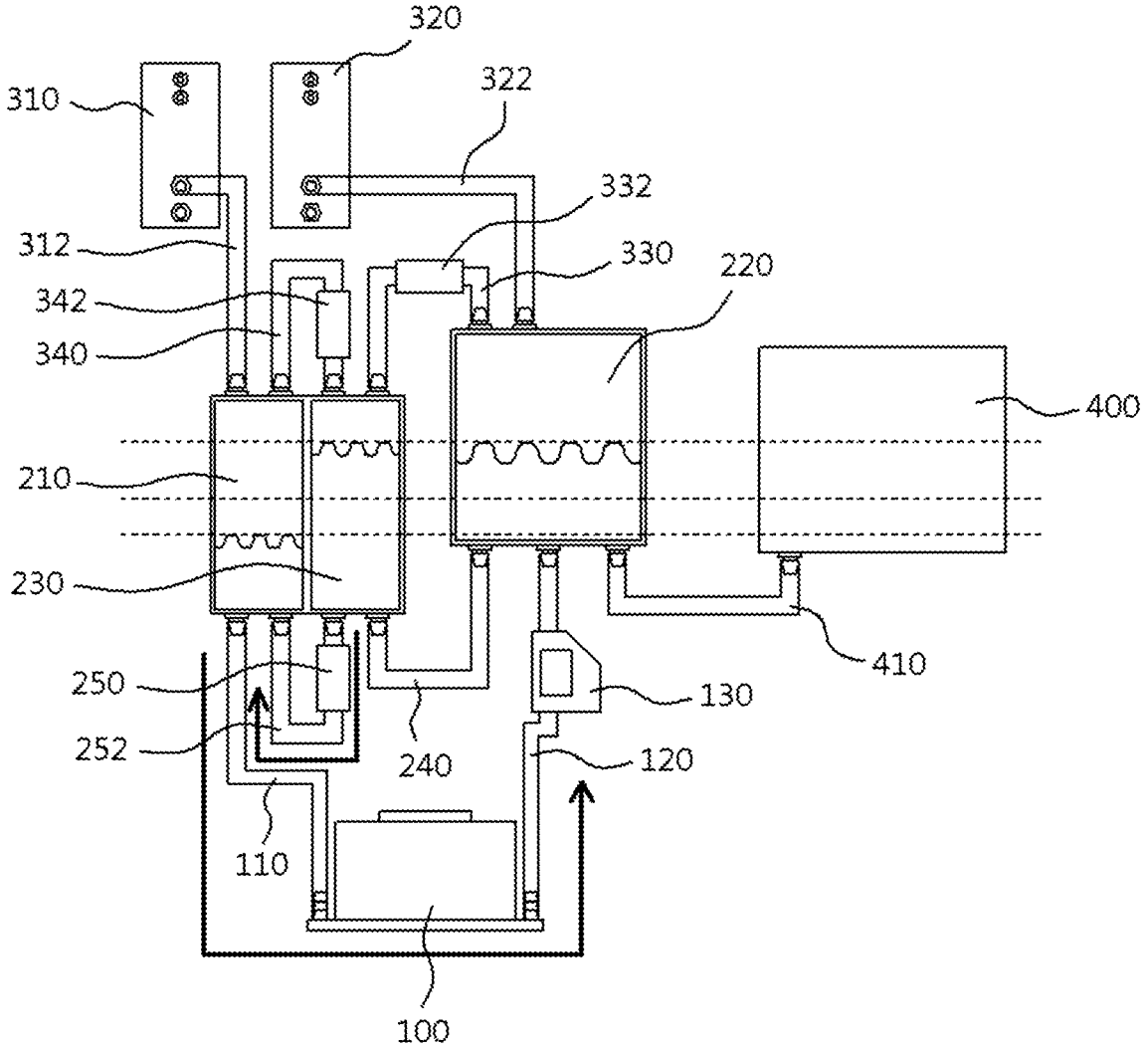

FIGS. 2 to 4 are views illustrating an operation of the ink circulation supply system for the inkjet head according to the embodiment of the present invention.

FIG. 2 illustrates a state in which ink exiting from the meniscus reservoir 210 starts to be moved to the circulation reservoir 220 via the inkjet head 100.

First, FIG. 2 illustrates a state in which ink starts to circulate, and description will be given on the basis of a state in which the first pressure valve 332, the second pressure valve 342, and the ink valve 250 are all closed.

The meniscus reservoir 210 maintains a negative pressure condition for the inkjet head 100 to maintain the meniscus state, and the negative pressure of the meniscus reservoir 210 is maintained at a nearly constant pressure by the first pressure controller 310. Further, the internal pressure of the circulation reservoir 220 is controlled to a lower pressure than the meniscus reservoir 210 by the second pressure controller 320.

In this case, due to the fact that the first pressure valve 332 and the second pressure valve 342 are both closed, the pressure difference between the meniscus reservoir 210 and the circulation reservoir 220 is maintained. Even when the levels of ink filled in the circulation reservoir 210 and the circulation reservoir 220 are the same, ink of the meniscus reservoir 210 is moved to the circulation reservoir 220 due to the pressure difference between the meniscus reservoir 210 and the circulation reservoir 220.

Further, due to the fact that the ink valve 250 is closed, ink of the meniscus reservoir 210 flows through the supply passage 110 and is moved, via the inkjet head 100, to the circulation reservoir 220 through the recovery passage 120.

Due to the fact that the negative pressure of the meniscus reservoir 210 is maintained at the nearly constant pressure, the pressure difference between the meniscus reservoir 210 and the circulation reservoir 220 may be controlled by controlling the internal pressure of the circulation reservoir 220. Further, controlling the pressure difference between the meniscus reservoir 210 and the circulation reservoir 220 may enable control of the flow rate of ink moving through the supply passage 110 and the recovery passage 120. The flow rate of ink increases with the increase in the pressure difference between the meniscus reservoir 210 and the circulation reservoir 220, and the flow rate of ink decreases with the decrease in the pressure difference between the meniscus reservoir 210 and the circulation reservoir 220.

This control of the flow rate of ink may be performed by a method of reaching the target flow rate on the basis of the flow rate measured by the flow sensor 130 provided in the path of movement of the ink. In the present embodiment, the flow sensor 130 is provided in the recovery passage 120 to measure the flow rate of ink. When the flow rate of ink flowing through the recovery passage 120 is less than the target flow rate, the pressure difference between the meniscus reservoir 210 and the circulation reservoir 220 is controlled to increase by controlling the second pressure controller 320 to further decrease the internal pressure of the circulation reservoir 220. On the other hand, when the flow rate of ink flowing through the recovery passage 120 is greater than the target flow rate, the pressure difference between the meniscus reservoir 210 and the circulation reservoir 220 is controlled to decrease by controlling the second pressure controller 320 to increase the internal pressure of the circulation reservoir 220.

When the state of FIG. 2 is maintained, ink of the meniscus reservoir 210 flows through the supply passage 110 and is moved, via the inkjet head 100, to the circulation reservoir 220 through the recovery passage 120. Thus, the level of ink of the meniscus reservoir 210 gradually decreases, the level of ink of the circulation reservoir 220 gradually increases, and the level of ink of the ante reservoir 230 remains the same, whereby a state as illustrated in FIG. 3 is reached.

When the state as illustrated in FIG. 3 is reached, the first pressure valve 332 is gradually opened, while the second pressure valve 342 and the ink valve 250 remain closed.

As the first pressure valve 332 is gradually opened, the internal pressure of the circulation reservoir 220 and the internal pressure of the ante reservoir 230 gradually become the same, and a difference in head pressure due to a difference in level of ink occurs. The head pressure of each reservoir is a value that is obtained by adding internal pressure, and pressure due to the level of ink therein. In FIG. 2, the first pressure valve 332 is closed, and there is a difference in internal pressure between the ante reservoir 230 and the circulation reservoir 220, and thus ink of the circulation reservoir 220 is not moved to the ante reservoir 230 even though the ante reservoir 230 and the circulation reservoir 220 are connected to the first ink connection pipe 240 at which no separate valve is provided. On the other hand, when the first pressure valve 332 is gradually opened in the state of FIG. 3 and thus the internal pressure of the circulation reservoir 220 and the internal pressure of the ante reservoir 230 become the same, the difference in head pressure due to the difference in level of ink between the circulation reservoir 220 and the ante reservoir 230 occurs due to the same internal pressure, thereby causing ink of the circulation reservoir 220 to be moved to the ante reservoir 230 through the first ink connection pipe 240.

In this case, due to the fact that the second pressure valve 342 remains closed, the internal pressure of the circulation reservoir 220 and the internal pressure of the ante reservoir 230 do not affect the internal pressure of the meniscus reservoir 210. Additionally, due to the fact that the ink valve 250 remains closed, even when the level of ink of the ante reservoir 230 increases, ink of the ante reservoir 230 is not allowed to be moved to the meniscus reservoir 210.

As such, movement of ink from the circulation reservoir 220 to the ante reservoir 230 through the first ink connection pipe 240 occurs due to the difference in head pressure due to the difference in level of ink. Thus, as illustrated in FIG. 4, the movement of ink continues until the levels of ink of the circulation reservoir 220 and the ante reservoir 230 become the same.

When a state of FIG. 4 is reached, the first pressure valve 332 is first closed, and the second pressure valve 342 and the ink valve 250 are then opened.

As the second pressure valve 342 is gradually opened, the internal pressure of the meniscus reservoir 210 and the internal pressure of the ante reservoir 230 gradually become the same, and a difference in head pressure due to a difference in level of ink occurs.

The meniscus reservoir 210 is in a constant negative pressure state by operating the first pressure controller 310 in order to maintain the meniscus state of the inkjet head 100, and thus the internal pressure of the ante reservoir 230 is gradually adjusted to the internal pressure of the meniscus reservoir 210. In this case, due to the fact that the first pressure valve 332 remains closed, the internal pressure of the circulation reservoir 220 does not affect the internal pressures of the ante reservoir 230 and the meniscus reservoir 210.

As the internal pressure of the meniscus reservoir 210 and the internal pressure of the ante reservoir 230 gradually become the same, a difference in head pressure occurs due to a difference in level of ink between the meniscus reservoir 210 and the ante reservoir 230, and when the ink valve 250 is opened, ink of the ante reservoir 230 is moved to the meniscus reservoir 210 through the second ink connection pipe 252. In this case, when ink of the ante reservoir 230 is moved to the meniscus reservoir 210 too quickly, pulsation may occur due to a sudden change in level of ink and the meniscus state may not be maintained. Thus, the opening ratio of the ink valve 250 has to be appropriately controlled.

As described above, in the present embodiment, the ante reservoir 230 is located between the circulation reservoir 220 and the meniscus reservoir 210, and the first pressure valve 332 and the second pressure valve 342 are provided in the first pressure connection pipe 330 and the second pressure connection pipe 340 connecting the respective reservoirs at upper portions thereof. Further, the first pressure valve 332 and the second pressure valve 342 are configured not to be simultaneously opened but all closed or only one thereof is opened so that the internal pressures of the meniscus reservoir 210 and the circulation reservoir 220 do not affect each other, thereby enabling the meniscus reservoir 210 to maintain a constant negative pressure state to maintain the meniscus state. Consequently, it is possible to configure the ink circulation supply system for the inkjet head, the system being capable of: circulating ink by means of a difference in internal pressure between the meniscus reservoir 210 and the circulation reservoir 220, while maintaining the negative pressure state of the meniscus reservoir 210 constant; and circulating ink between the inkjet head the head supply reservoir, without requiring use of a pump.

In a state of FIG. 4, due to the difference in level of ink stored in the meniscus reservoir 210 and the ante reservoir 230, ink of the ante reservoir 230 is moved to the meniscus reservoir 210, and finally the height of ink becomes the height as illustrated in FIG. 2. As illustrated in FIG. 2, when the levels of ink stored in the meniscus reservoir 210 and the ante reservoir 230 become the same, the second pressure valve 342 is closed and then the first pressure valve 332 is gradually opened. Although in describing the opening/closing process of the first pressure valve 332 and the second pressure valve 342 as set forth above, steps thereof have been described separately, the respective steps are performed continuously. In particular, in order to continuously circulate ink, the difference in head pressure between the meniscus reservoir 210 and the circulation reservoir 220 have to be maintained continuously. Thus, it is preferable to maintain the first pressure valve 332 always open, except when the second pressure valve 342 is opened.

Figure 5:
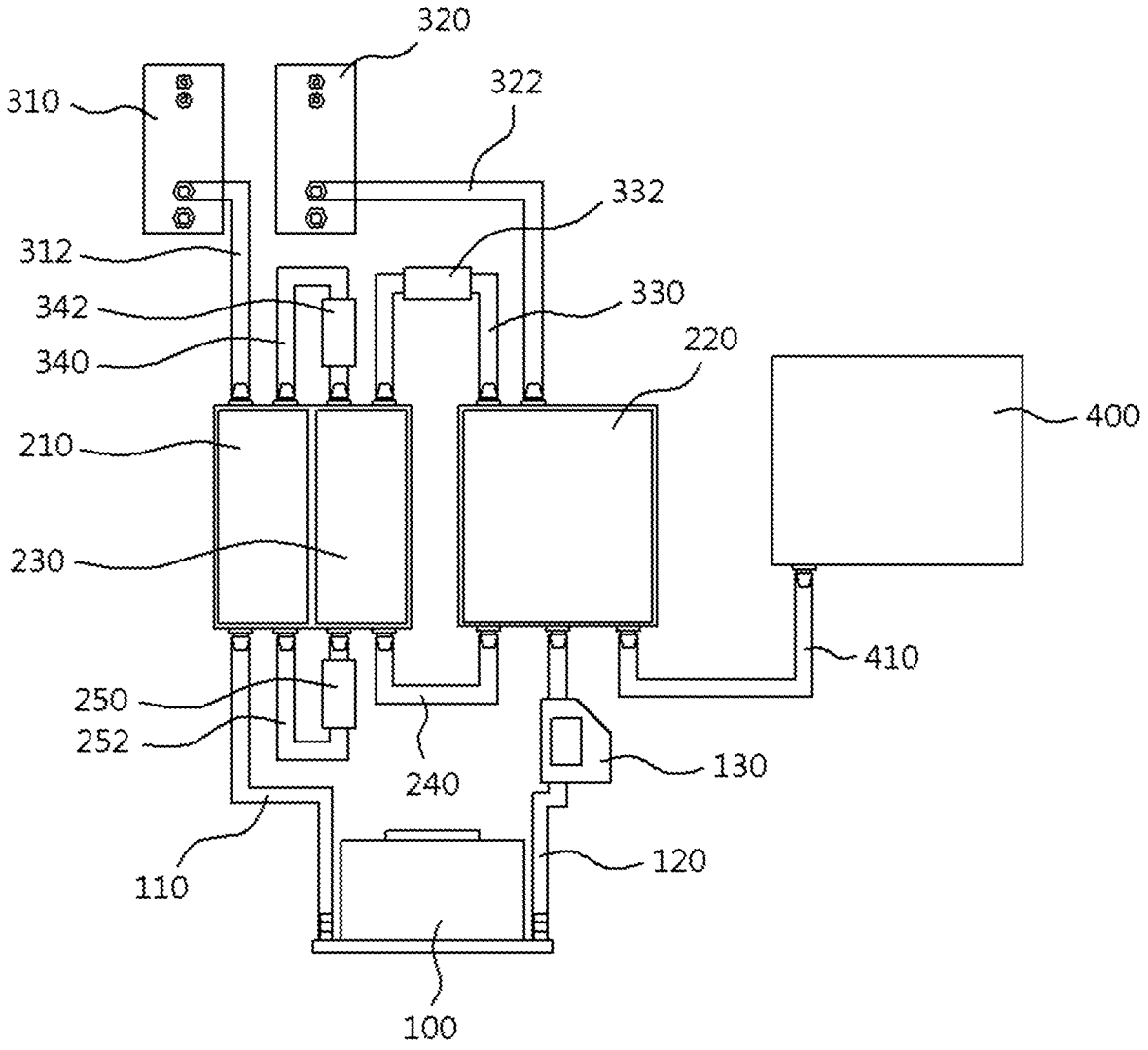
FIG. 5 is a view illustrating an embodiment in which reservoirs are configured to have the same bottom height in the ink circulation supply system for the inkjet head of FIG. 1.

Further, as illustrated, when the bottom height of the circulation reservoir 220 is higher than those of the meniscus reservoir 210 and the ante reservoir 230, the effect of head pressure due to the difference in level of ink occurring between the reservoirs is improved. Thus, as illustrated in FIG. 5, it is possible that the meniscus reservoir 210, the circulation reservoir 220, and the ante reservoir 230 are configured to have the same bottom height. However, in order to improve circulation efficiency, it is preferable that the bottom height of the circulation reservoir 220 is relatively higher.

When the ink circulation supply system for the inkjet head according to the present invention is employed, it is possible to increase fluidity, dispersibility, and homogeneity of ink, thereby supplying ink having fluidity, dispersibility, and homogeneity maintained to the inkjet head. Additionally, due to the fact that use of a pump is not necessary, there is an excellent effect that a problem such as malfunction of the pump does not occur.

Figure 6:
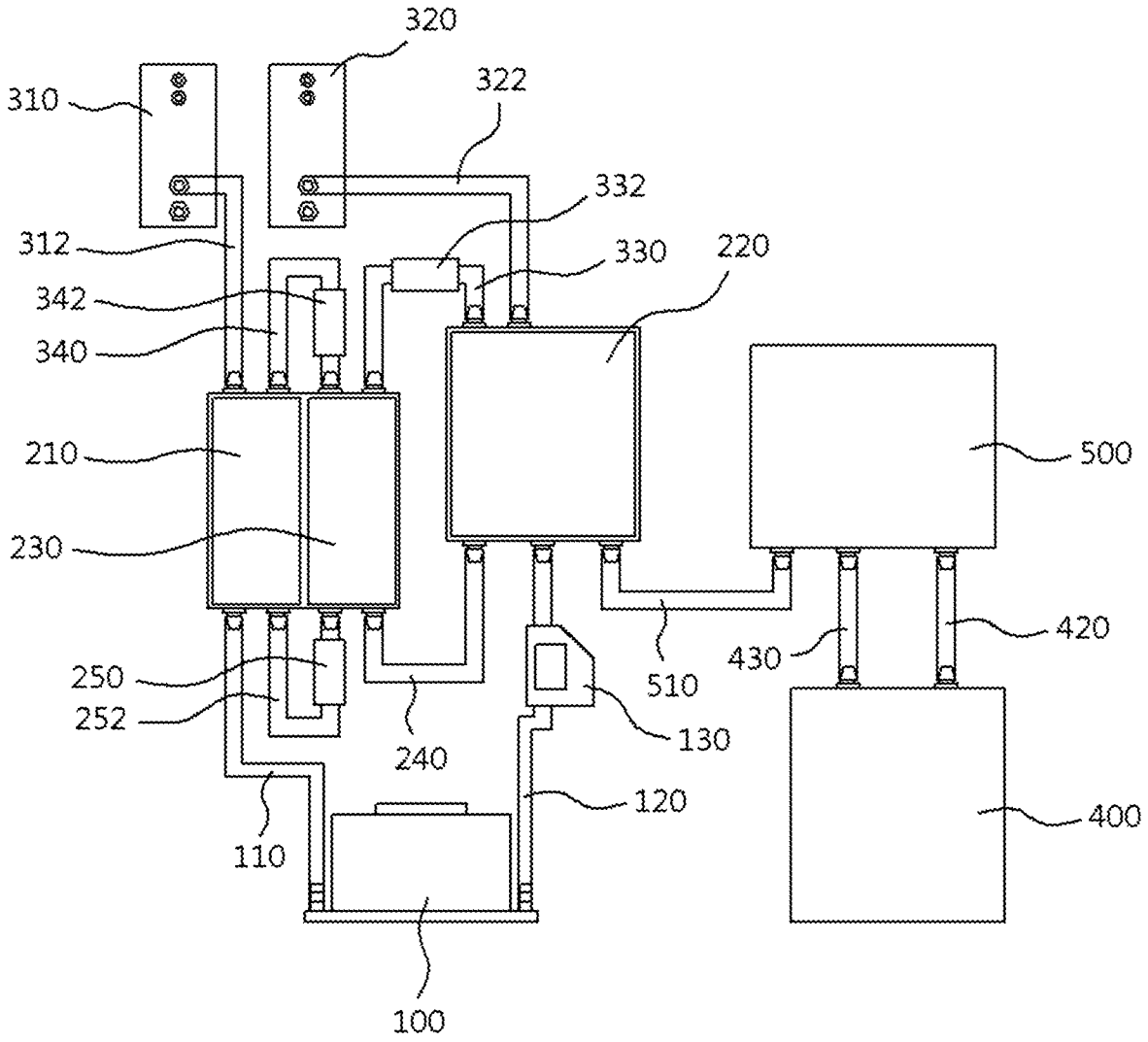
FIG. 6 is a view illustrating an embodiment in which a buffer reservoir and an external circulation supply structure are added to the ink circulation supply system for the inkjet head of FIG. 1.

FIG. 6 is a view illustrating an embodiment in which a buffer reservoir and an external circulation supply structure are added to the ink circulation supply system for the inkjet head of FIG. 1.

While a structure in which ink is injected from the ink reservoir tank 400 provided externally to the circulation reservoir 220 through the first injection pipe 410 is illustrated in FIG. 1, the embodiment of FIG. 6 provides a structure in which a buffer reservoir 500 is additionally provided between the ink reservoir tank 400 and the circulation reservoir 220, and ink of the buffer reservoir 500 is injected into the circulation reservoir 220 through a second injection pipe 510. Further, two transport pipes 420 and 430 are connected to the buffer reservoir 500 and the ink reservoir tank 400 at positions therebetween and are configured to circulate ink in the process of externally supplying ink through the pipes. In this case, the second injection pipe 510 may be connected to the meniscus reservoir 210 or the ante reservoir 230.

The buffer reservoir 500 is a component that temporarily stores ink before supplying ink to the circulation reservoir 220 constituting the head supply reservoir, and is configured to transfer ink between the ink reservoir tank 400 storing a large amount of ink and the head supply reservoir. The buffer reservoir 500 is generally provided inside the inkjet printer, but the present invention is not limited thereto. For example, the buffer reservoir 500 may be provided outside the inkjet printer depending on the structure of printers.

Conventionally, the buffer reservoir 500 is also used for the purpose of maintaining the meniscus state of the inkjet head 100. In the present embodiment, the buffer reservoir 500 may be used to perform a function for maintaining the internal pressure of the circulation reservoir 220 controlled by the second pressure controller 320. Further, the buffer reservoir 500 may simultaneously perform a function for maintaining the internal pressure of the circulation reservoir 220 and a function for maintaining fluidity, dispersibility, and homogeneity of ink.

The buffer reservoir 500 and the circulation reservoir 220 are connected to the second injection pipe 510 through which ink is moved, and ink of the buffer reservoir 500 is selectively supplied to the circulation reservoir 220 by a method such as providing a valve at the second injection pipe 510.

The ink reservoir tank 400 is a configuration for storing a relatively large amount of ink and supplying ink to the buffer reservoir 500. In general, an industrial inkjet printer consumes a large amount of ink, and thus is configured not only that the inkjet head 100 and the head supply reservoir are separated, but also that the ink reservoir tank 400 is separately provided externally of the inkjet printer to continuously supply ink to the head supply reservoir.

In the present embodiment, the structure in which ink is supplied from the ink reservoir tank 400 provided externally to the head supply reservoir via the buffer reservoir 500 is provided. Additionally, it is characterized in that the buffer reservoir 500 and the ink reservoir tank 400 are connected to each other by the two transport pipes 420 and 430 through which ink is moved, and thus unlike related art techniques using a single transport pipe to allow only one-directional movement of ink, ink may be continuously circulated between the buffer reservoir 500 and the ink reservoir tank 400.

In detail, the first transport pipe 420 transports ink from the ink reservoir tank 400 to the buffer reservoir 500, and the second transport pipe 430 transports ink from the buffer reservoir 500 to the ink reservoir tank 400.

In order for the inkjet head 100 to operate in the inkjet printer according to the present embodiment, ink has to be continuously supplied. However, the process in which ink is supplied to the head supply reservoir in order to maintain the meniscus state and maintain the internal pressure of the circulation reservoir 220 is performed intermittently or at a slow speed. Due thereto, the buffer reservoir 500 and the ink reservoir tank 400 are in a state such that ink is stagnant for a long time. In this case, when using the kind of ink in which contents thereof tend to be easily separated from each other or ink in which metal particles, a flat panel display material, or an OLED material is dispersed, separation may occur in stagnant ink, thereby deteriorating homogeneity of ink, and there arises a problem that printing may not be performed smoothly due to supply of separated ink to the inkjet head 100.

In the present embodiment, ink is not only supplied in one direction from the ink reservoir tank 400 toward the buffer reservoir 500, but also transported from the buffer reservoir 500 toward the ink reservoir tank 400 through the second transport pipe 430 so that ink is circulated for continuous movement. Thus, this makes it possible to maintain dispersibility and homogeneity of ink. In detail, even when ink is not additionally supplied to the buffer reservoir 500, ink may be circulated in a manner that ink is transported to the buffer reservoir 500 through the first transport pipe 420 while ink is returned to the ink reservoir tank 400 through the second transport pipe 430. When ink needs to be additionally supplied to the buffer reservoir 500, ink may be additionally supplied to the buffer reservoir 500, while maintaining circulation thereof in such a manner of stopping transportation of ink through the second transport pipe 430, or controlling the amount of ink so that the amount of ink moved through the first transport pipe 420 is greater than that moved through the second transport pipe 430.

As a method of supplying ink from the ink reservoir tank 400 provided externally to the buffer reservoir 500, both a method of pressurizing the ink reservoir tank 400 and a method of using a pump are possible, and it is preferable that a valve is provided in each of the first transport pipe 420 and the second transport pipe 520 in order to control whether ink is circulated and a circulation amount of ink.

In this case, an agitator for agitating stored ink may be provided inside the buffer reservoir 500. As the agitator, a typical rotary agitator may be employed. In particular, a magnetic agitator that rotates by magnetic force may be employed. In general, it is difficult to maintain dispersibility and homogeneity of ink only by use of the agitator. However, in the present embodiment, due to the fact that ink is continuously circulated externally between the buffer reservoir 500 and the ink reservoir tank 400, dispersibility and homogeneity of ink may be further increased by use of the agitator.

In order to maintain the internal pressure of the ink reservoir tank 400 in the process of additionally supplying ink from the ink reservoir tank 400 to the buffer reservoir 500, a gas supplier for supplying clean dry air (CDA) or $N_2$ may be connected to the ink reservoir tank 400, and a vent for maintaining the internal pressure of the buffer reservoir 500 may be connected to the buffer reservoir 500. For the gas supplier and the vent, any known techniques may be employed without limitation, and thus a detailed description thereof will be omitted.

In the inkjet printer described above, ink is circulated internally between the inkjet head 100 and the head supply reservoir, and simultaneously ink is circulated externally between the ink reservoir tank 400 and the buffer reservoir 500, and thus ink may be stored in the ink reservoir tank 400 and the buffer reservoir 500 while maintaining dispersibility and homogeneity thereof, and ink having dispersibility and homogeneity maintained may be supplied to the head supply reservoir. Thus, consequently, ink having dispersibility and homogeneity maintained may be supplied to the inkjet head 100.

When the ink circulation supply system of the inkjet printer according to the present invention is employed, a product may be manufactured through an inkjet printing process using ink, which have recently been of interest, in which metal particles, a flat panel display material, or an OLED material is dispersed. Consequently, due to the characteristics of the inkjet printing process that can perform a precise process quickly, there is an excellent effect that efficiency of a process for manufacturing an electrode, a flat panel display, or an OLED is greatly improved.

Figure 7:
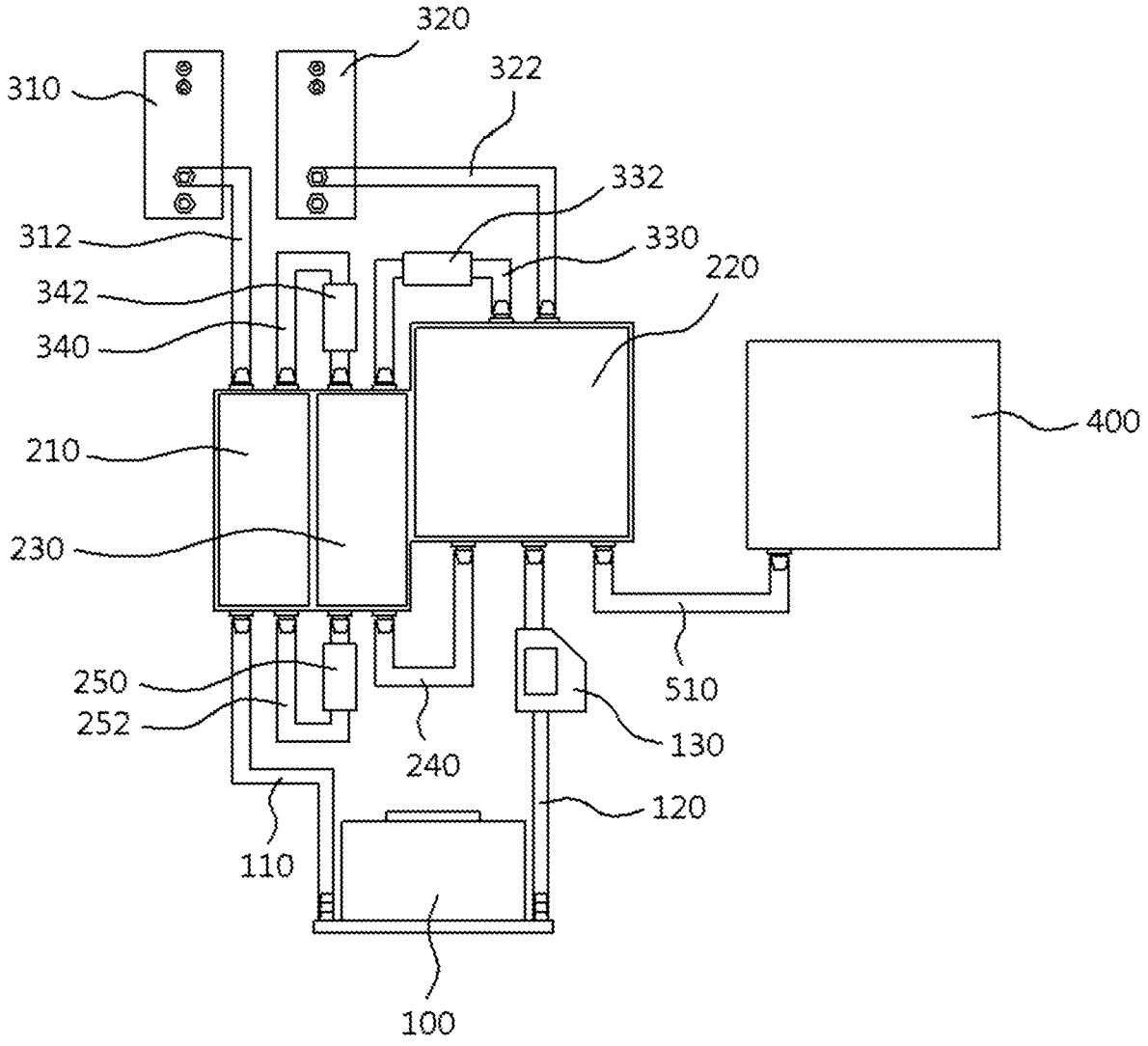
FIG. 7 is a view illustrating a structure of an ink circulation supply system for an inkjet head according to another embodiment of the present invention.

FIG. 7 is a view illustrating a structure of an ink circulation supply system for an inkjet head according to another embodiment of the present invention.

The ink circulation supply system for the inkjet head according to the present invention is characterized in that three reservoirs 210, 220, and 230 that function as the existing head supply reservoir are separated from each other.

In this case, the external structures of a meniscus reservoir 210, a circulation reservoir 220, and an ante reservoir 230 are not particularly limited, as long as the internal spaces of the respective reservoirs are separated from each other so that the internal pressures thereof are controlled independently.

In FIG. 1, a configuration in which the meniscus reservoir 210 and the ante reservoir 230 are located in separate spaces in the same casing, and the circulation reservoir 220 is located in a separate casing.

The embodiment illustrated in FIG. 7 is a case in which the meniscus reservoir 210, the circulation reservoir 220, and the ante reservoir 230 are arranged independently in separate spaces in the same casing. In this case, a first pressure connection pipe 330 connects the circulation reservoir 220 and the ante reservoir 230 to each other at upper portions thereof, a second pressure connection pipe 340 connects the ante reservoir 230 and the meniscus reservoir 210 to each other at upper portions thereof, and a first pressure valve 332 and a second pressure valve 342 are provided in the first pressure connection pipe 330 and the second pressure connection pipe 340, respectively. This structure is the same as that of the embodiment of FIG. 1. Further, a first ink connection pipe 240 connects the circulation reservoir 220 and the ante reservoir 230 to each other at lower portions thereof, a second ink connection pipe 252 connects the ante reservoir 230 and the meniscus reservoir 210 to each other at lower portions thereof, and an ink valve 250 is provided only at the second ink connection pipe 252. This structure is the same as that of the embodiment of FIG. 1.

In this case, when the meniscus reservoir 210, the circulation reservoir 220, and the ante reservoir 230 are arranged independently in separate spaces in the same casing as illustrated in FIG. 7, the first pressure connection pipe 330, the second pressure connection pipe 340, the first ink connection pipe 240, and the second ink connection pipe 252 may be configured as separate pipes as illustrated, but the present invention is not limited thereto. For example, these pipes may be configured as passages formed inside the casing.

In consideration of the fact that when the internal pressures of the meniscus reservoir 210 and the ante reservoir 230 become the same and when the internal pressures of the meniscus reservoir 210 and the ante reservoir 230 become the same, a difference in head pressure due to the level of ink stored therein occurs, the meniscus reservoir 210 and the ante reservoir 230 are designed to have the same bottom height while the circulation reservoir 220 is designed to have a relatively higher bottom height. This structure is also the same as that of the embodiment of FIG. 1.

Other configurations and a method of circulating ink by means of a difference in internal pressure occurring between three reservoirs are the same as those of the embodiment of FIG. 1 described above, and thus a further description thereof will be omitted.

When the ink circulation supply system for the inkjet head as above is employed, it is possible to increase fluidity, dispersibility, and homogeneity of ink, thereby supplying ink having fluidity, dispersibility, and homogeneity maintained to the inkjet head. Additionally, due to the fact that use of a pump is not necessary, there is an excellent effect that a problem such as malfunction of the pump does not occur.

Figure 8:
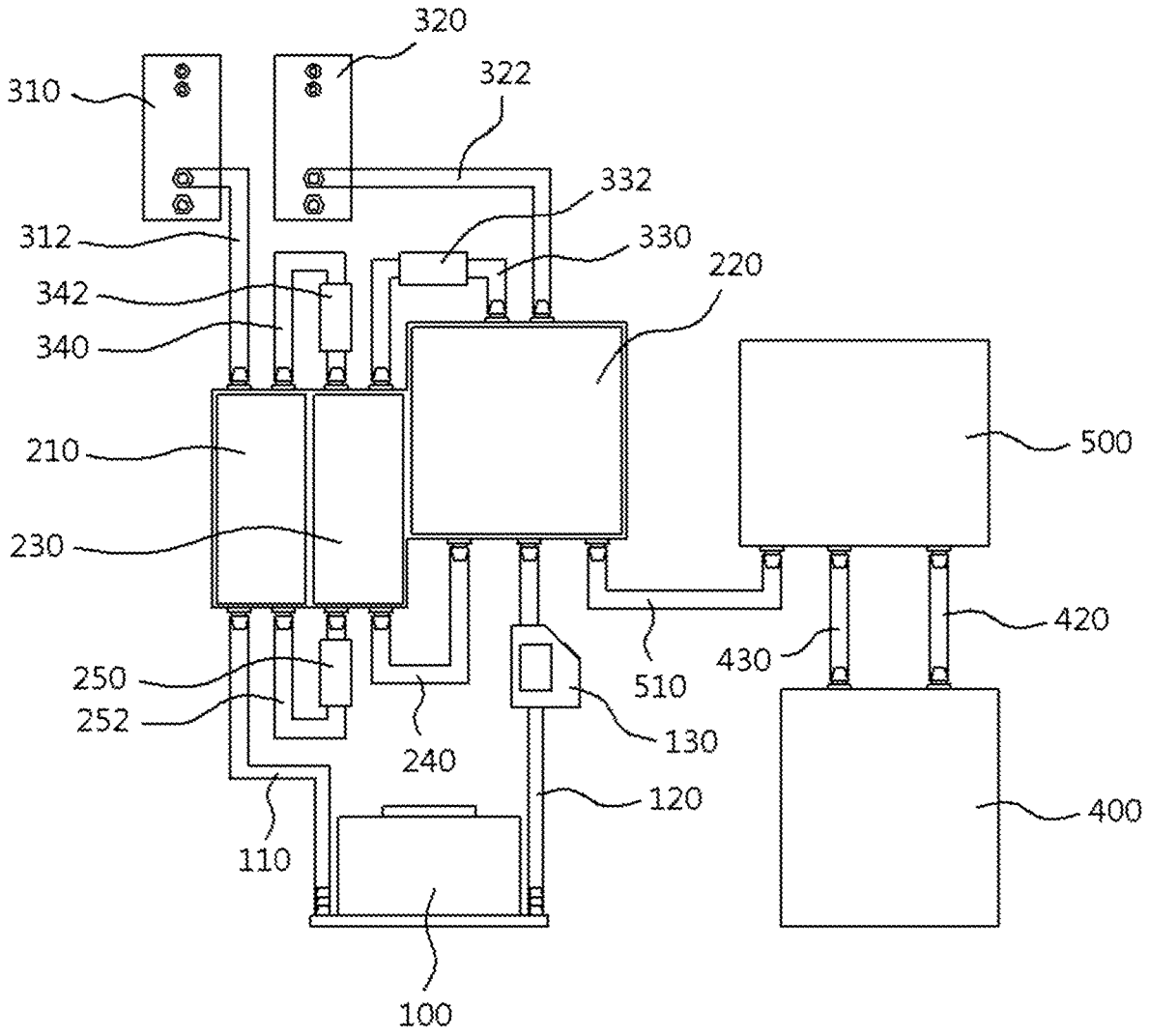
FIG. 8 is a view illustrating an embodiment in which a buffer reservoir and an external circulation supply structure are added to the ink circulation supply system for the inkjet head of FIG. 7.

FIG. 8 is a view illustrating an embodiment in which a buffer reservoir and an external circulation supply structure are added to the ink circulation supply system for the inkjet head of FIG. 7.

While a structure in which ink is injected from an ink reservoir tank 400 provided externally to a circulation reservoir 220 through a first injection pipe 410 is illustrated in FIG. 7, the embodiment of FIG. 8 provides a structure in which a buffer reservoir 500 is additionally provided between an ink reservoir tank 400 provided externally and a circulation reservoir 220, and ink of the buffer reservoir 500 is injected into the circulation reservoir 220 through a second injection pipe 510. Further, two transport pipes 420 and 430 are connected to the buffer reservoir 500 and the ink reservoir tank 400 at positions therebetween and are configured to circulate ink in the process of externally supplying ink through the pipes.

Other configurations and a configuration in which ink is circulated externally between the buffer reservoir and the ink reservoir tank are the same as those of the embodiment of FIG. 6 described above, and thus a further description thereof will be omitted.

When the ink circulation supply system of the inkjet printer according to the present invention is employed, a product may be manufactured through an inkjet printing process using ink, which has recently been of interest, in which metal particles, a flat panel display material, or an OLED material is dispersed. Consequently, due to the characteristics of the inkjet printing process that can perform a precise process quickly, there is an excellent effect that efficiency of a process for manufacturing an electrode, a flat panel display, or an OLED is greatly improved.

Figure 9:
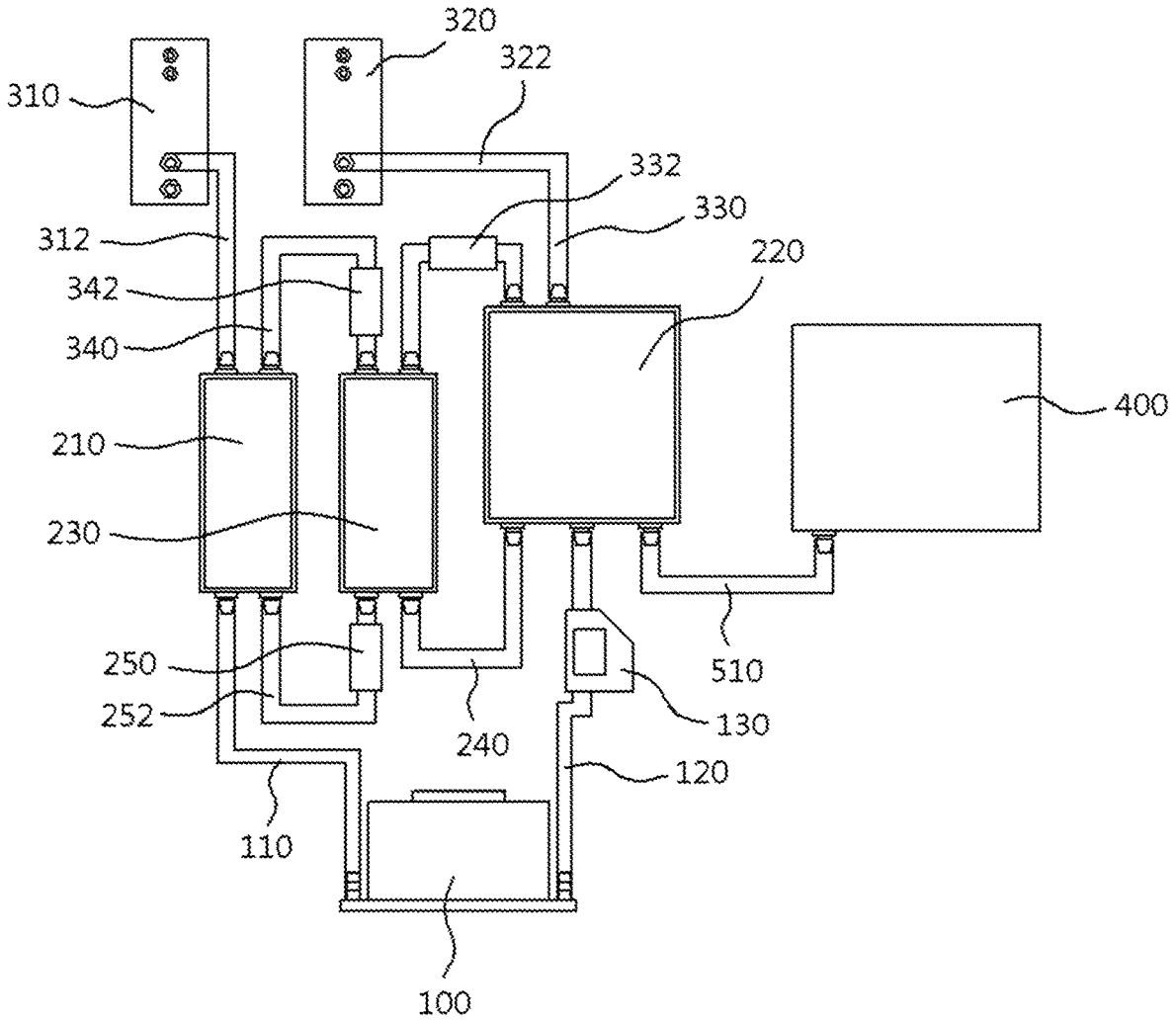
FIG. 9 is a view illustrating a structure of an ink circulation supply system for an inkjet head according to another embodiment of the present invention.

FIG. 9 is a view illustrating a structure of an ink circulation supply system for an inkjet head according to another embodiment of the present invention.

The ink circulation supply system for the inkjet head according to the present invention is characterized in that three reservoirs 210, 220, and 230 that function as the existing head supply reservoir are separated from each other.

In this case, the external structures of a meniscus reservoir 210, a circulation reservoir 220, and an ante reservoir 230 are not particularly limited, as long as the internal spaces of the respective reservoirs are separated from each other so that the internal pressures thereof are controlled independently.

In FIG. 1, a configuration in which the meniscus reservoir 210 and the ante reservoir 230 are located in separate spaces in the same casing, and the circulation reservoir 220 is located in a separate casing.

The embodiment illustrated in FIG. 9 is a case in which the meniscus reservoir 210, the circulation reservoir 220, and the ante reservoir 230 are arranged independently in different casings. In this case, a first pressure connection pipe 330 connects the circulation reservoir 220 and the ante reservoir 230 to each other at upper portions thereof, a second pressure connection pipe 340 connects the ante reservoir 230 and the meniscus reservoir 210 to each other at upper portions thereof, and a first pressure valve 332 and a second pressure valve 342 are provided in the first pressure connection pipe 330 and the second pressure connection pipe 340, respectively. This structure is the same as that of the embodiment of FIG. 1. Further, a first ink connection pipe 240 connects the circulation reservoir 220 and the ante reservoir 230 to each other at lower portions thereof, a second ink connection pipe 252 connects the ante reservoir 230 and the meniscus reservoir 210 to each other at lower portions thereof, and an ink valve 250 is provided only at the second ink connection pipe 252. This structure is the same as that of the embodiment of FIG. 1.

In this case, in consideration of the fact that when the internal pressures of the meniscus reservoir 210 and the ante reservoir 230 become the same and when the internal pressures of the meniscus reservoir 210 and the ante reservoir 230 become the same, a difference in head pressure due to the level of ink stored therein occurs, the meniscus reservoir 210 and the ante reservoir 230 are designed to have the same bottom height while the circulation reservoir 220 is designed to have a relatively higher bottom height. This structure is also the same as that of the embodiment of FIG. 1.

Other configurations and a method of circulating ink by means of a difference in internal pressure occurring between three reservoirs are the same as those of the embodiment of FIG. 1 described above, and thus a further description thereof will be omitted.

When the ink circulation supply system for the inkjet head as above is employed, it is possible to increase fluidity, dispersibility, and homogeneity of ink, thereby supplying ink having fluidity, dispersibility, and homogeneity maintained to the inkjet head. Additionally, due to the fact that use of a pump is not necessary, there is an excellent effect that a problem such as malfunction of the pump does not occur.

Figure 10:
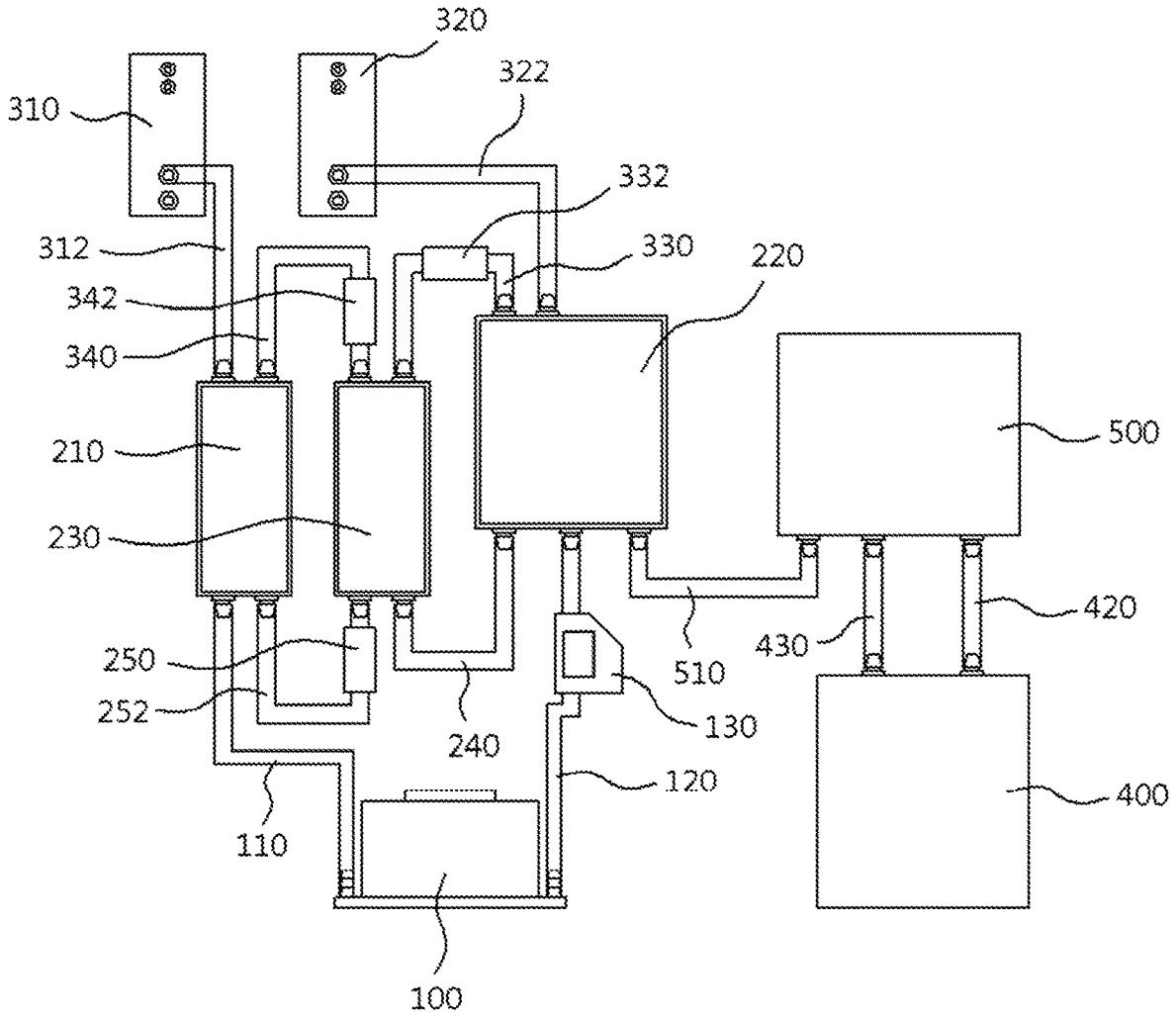
FIG. 10 is a view illustrating an embodiment in which a buffer reservoir and an external circulation supply structure are added to the ink circulation supply system for the inkjet head of FIG. 9.

FIG. 10 is a view illustrating an embodiment in which a buffer reservoir and an external circulation supply structure are added to the ink circulation supply system for the inkjet head of FIG. 9.

While a structure in which ink is injected from an ink reservoir tank 400 provided externally to a circulation reservoir 220 through a first injection pipe 410 is illustrated in FIG. 9, the embodiment of FIG. 10 provides a structure in which a buffer reservoir 500 is additionally provided between an ink reservoir tank 400 provided externally and a circulation reservoir 220, and ink of the buffer reservoir 500 is injected into the circulation reservoir 220 through a second injection pipe 510. Further, two transport pipes 420 and 430 are connected to the buffer reservoir 500 and the ink reservoir tank 400 at positions therebetween and are configured to circulate ink in the process of externally supplying ink through the pipes.

Other configurations and a configuration in which ink is circulated externally between the buffer reservoir and the ink reservoir tank are the same as those of the embodiment of FIG. 6 described above, and thus a further description thereof will be omitted.

When the ink circulation supply system of the inkjet printer according to the present invention is employed, a product may be manufactured through an inkjet printing process using ink, which have recently been of interest, in which metal particles, a flat panel display material, or an OLED material is dispersed. Consequently, due to the characteristics of the inkjet printing process that can perform a precise process quickly, there is an excellent effect that efficiency of a process for manufacturing an electrode, a flat panel display, or an OLED is greatly improved.

Figure 11:
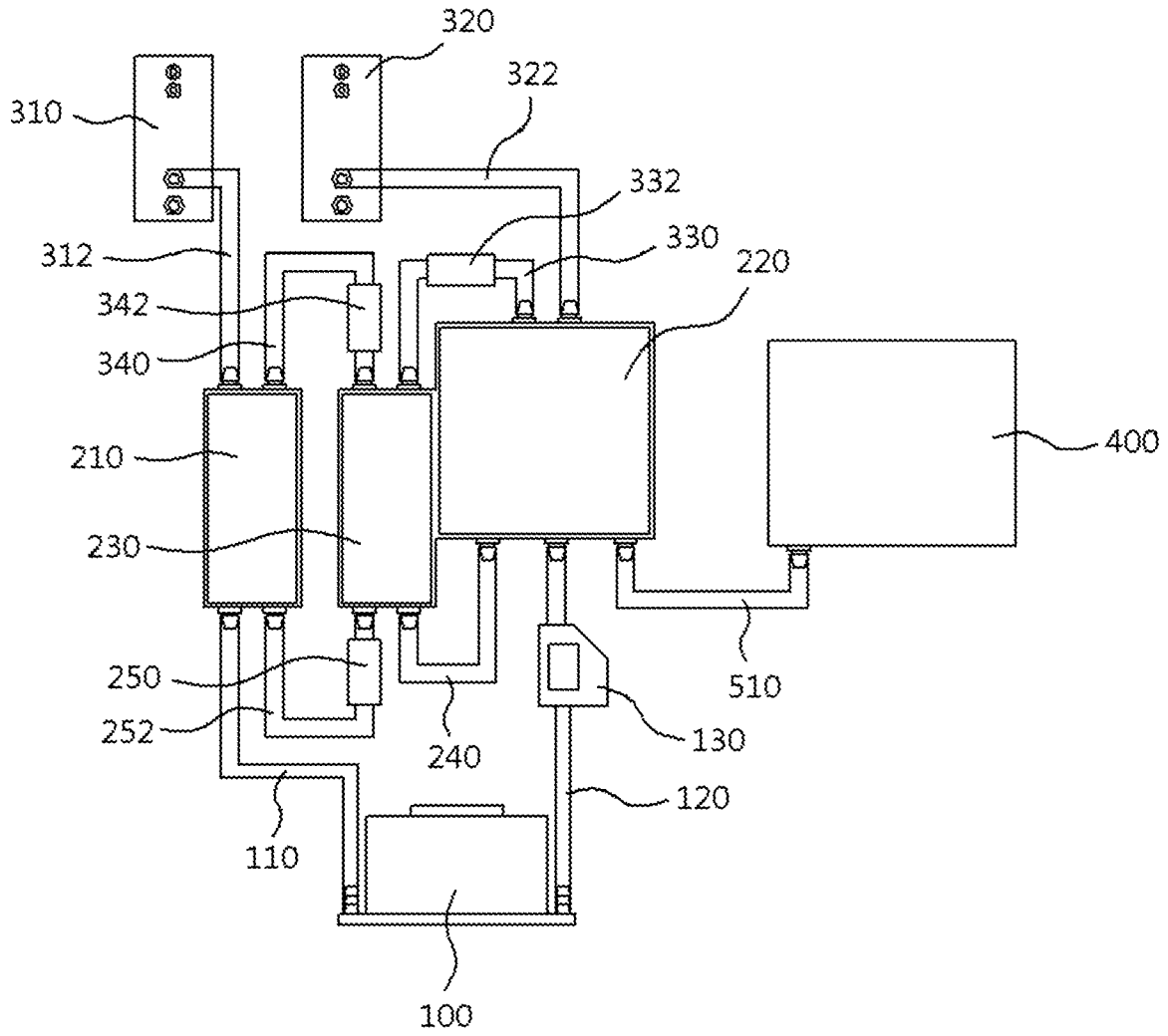
FIG. 11 is a view illustrating a structure of an ink circulation supply system for an inkjet head according to another embodiment of the present invention.

FIG. 11 is a view illustrating a structure of an ink circulation supply system for an inkjet head according to another embodiment of the present invention.

The ink circulation supply system for the inkjet head according to the present invention is characterized in that three reservoirs 210, 220, and 230 that function as the existing head supply reservoir are separated from each other.

In this case, the external structures of a meniscus reservoir 210, a circulation reservoir 220, and an ante reservoir 230 are not particularly limited, as long as the internal spaces of the respective reservoirs are separated from each other so that the internal pressures thereof are controlled independently.

In FIG. 1, a configuration in which the meniscus reservoir 210 and the ante reservoir 230 are located in separate spaces in the same casing, and the circulation reservoir 220 is located in a separate casing.

In the embodiment illustrated in FIG. 11, the meniscus reservoir 210 is located in a separate casing, and the ante reservoir 230 and the circulation reservoir 220 are located independently in separate spaces in the same casing. In this case, a first pressure connection pipe 330 connects the circulation reservoir 220 and the ante reservoir 230 to each other at upper portions thereof, a second pressure connection pipe 340 connects the ante reservoir 230 and the meniscus reservoir 210 to each other at upper portions thereof, and a first pressure valve 332 and a second pressure valve 342 are provided in the first pressure connection pipe 330 and the second pressure connection pipe 340, respectively. This structure is the same as that of the embodiment of FIG. 1. Further, a first ink connection pipe 240 connects the circulation reservoir 220 and the ante reservoir 230 to each other at lower portions thereof, a second ink connection pipe 252 connects the ante reservoir 230 and the meniscus reservoir 210 to each other at lower portions thereof, and an ink valve 250 is provided only at the second ink connection pipe 252. This structure is the same as that of the embodiment of FIG. 1.

In this case, when the circulation reservoir 220 and the ante reservoir 230 are arranged independently in separate spaces in the same casing as illustrated in FIG. 11, the first pressure connection pipe 330 and the first ink connection pipe 240 may be configured as separate pipes as illustrated, but the present invention is not limited thereto. For example, these pipes may be configured as passages formed inside the casing.

In consideration of the fact that when the internal pressures of the meniscus reservoir 210 and the ante reservoir 230 become the same and when the internal pressures of the meniscus reservoir 210 and the ante reservoir 230 become the same, a difference in head pressure due to the level of ink stored therein occurs, the meniscus reservoir 210 and the ante reservoir 230 are designed to have the same bottom height while the circulation reservoir 220 is designed to have a relatively higher bottom height. This structure is also the same as that of the embodiment of FIG. 1.

Other configurations and a method of circulating ink by means of a difference in internal pressure occurring between three reservoirs are the same as those of the embodiment of FIG. 1 described above, and thus a further description thereof will be omitted.

When the ink circulation supply system for the inkjet head as above is employed, it is possible to increase fluidity, dispersibility, and homogeneity of ink, thereby supplying ink having fluidity, dispersibility, and homogeneity maintained to the inkjet head. Additionally, due to the fact that use of a pump is not necessary, there is an excellent effect that a problem such as malfunction of the pump does not occur.

Figure 12:
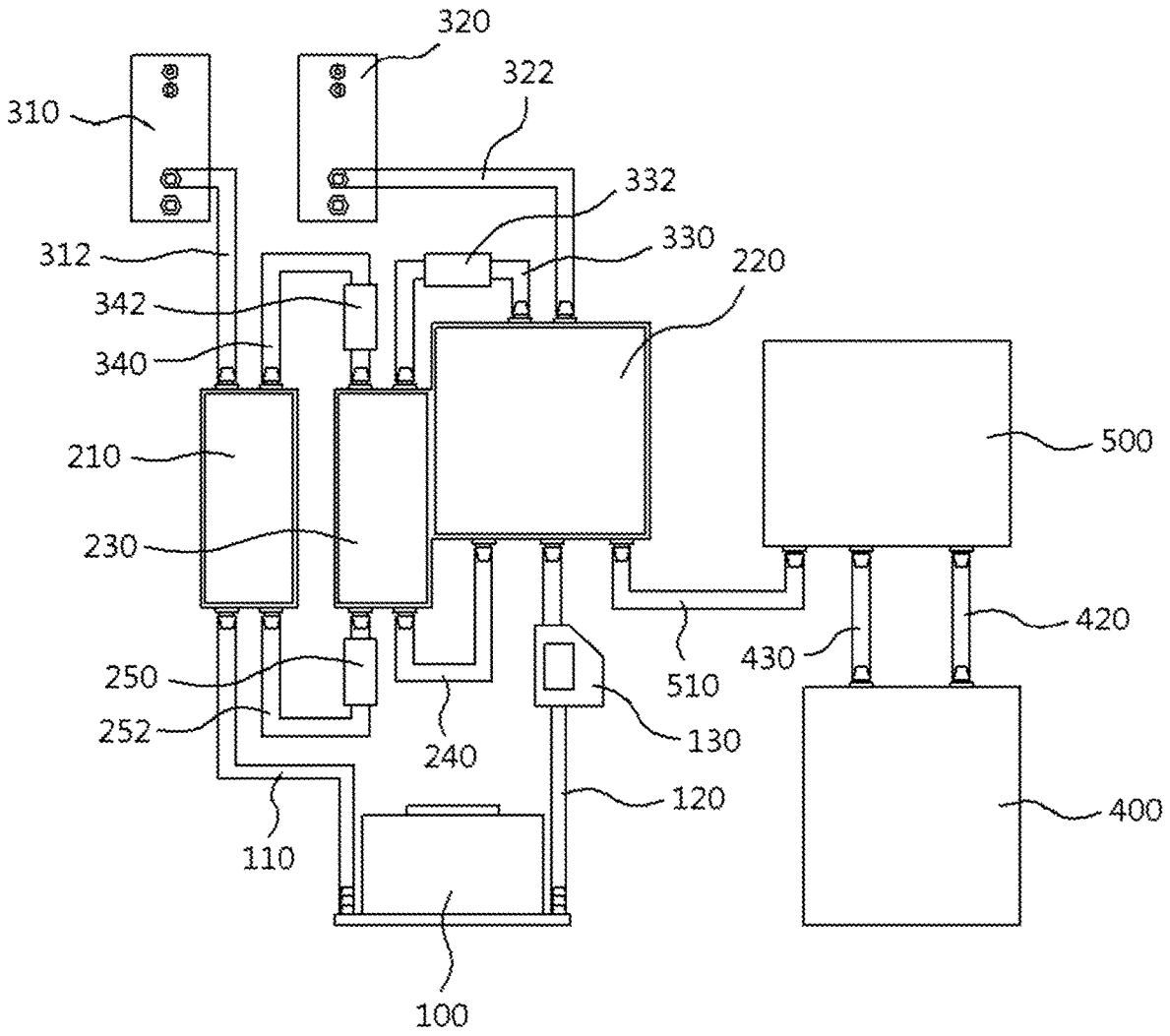
FIG. 12 is a view illustrating an embodiment in which a buffer reservoir and an external circulation supply structure are added to the ink circulation supply system for the inkjet head of FIG. 11.
Figure 13:
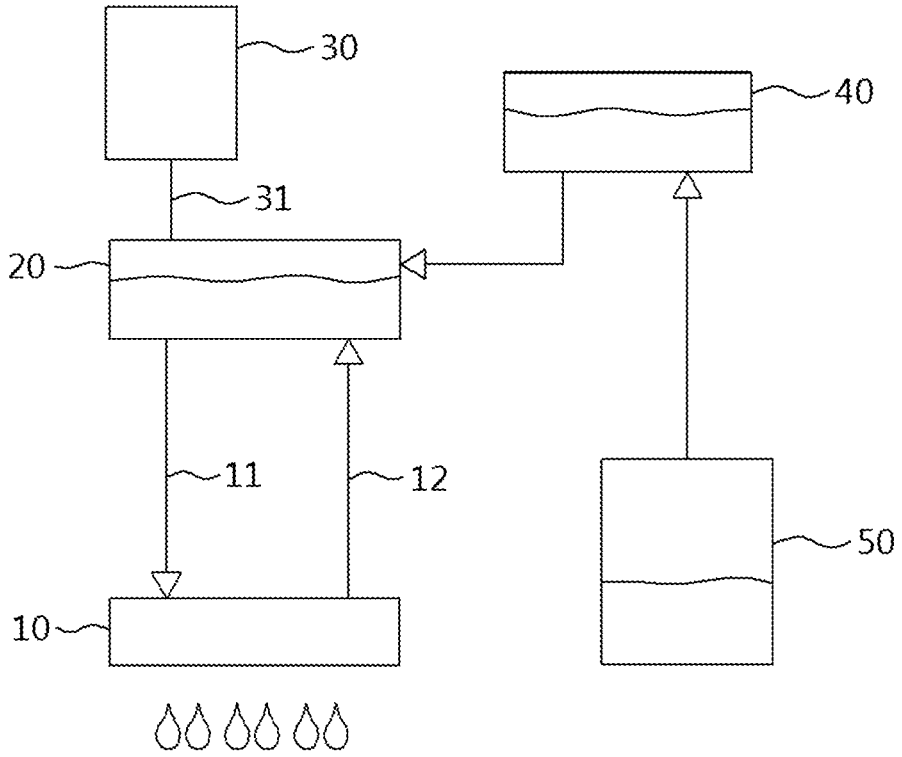
Related Art Fig. 13
FIG. 13 is a schematic view illustrating the structure of a typical industrial inkjet printer.

FIG. 12 is a view illustrating an embodiment in which a buffer reservoir and an external circulation supply structure are added to the ink circulation supply system for the inkjet head of FIG. 11.

While a structure in which ink is injected from an ink reservoir tank 400 provided externally to a circulation reservoir 220 through a first injection pipe 410 is illustrated in FIG. 11, the embodiment of FIG. 12 provides a structure in which a buffer reservoir 500 is additionally provided between an ink reservoir tank 400 provided externally and a circulation reservoir 220, and ink of the buffer reservoir 500 is injected into the circulation reservoir 220 through a second injection pipe 510. Further, two transport pipes 420 and 430 are connected to the buffer reservoir 500 and the ink reservoir tank 400 at positions therebetween and are configured to circulate ink in the process of externally supplying ink through the pipes.

Other configurations and a configuration in which ink is circulated externally between the buffer reservoir and the ink reservoir tank are the same as those of the embodiment of FIG. 6 described above, and thus a further description thereof will be omitted.

When the ink circulation supply system of the inkjet printer according to the present invention is employed, a product may be manufactured through an inkjet printing process using ink, which have recently been of interest, in which metal particles, a flat panel display material, or an OLED material is dispersed. Consequently, due to the characteristics of the inkjet printing process that can perform a precise process quickly, there is an excellent effect that efficiency of a process for manufacturing an electrode, a flat panel display, or an OLED is greatly improved.

While the exemplary embodiments of the present disclosure have been described above, the embodiments are only examples of the disclosure, and it will be understood by those skilled in the art that the disclosure can be modified in various forms without departing from the technical spirit of the disclosure. Thus, the scope of the disclosure should be determined on the basis of the descriptions in the appended claims, not any specific embodiment, and all equivalents thereof should belong to the scope of the disclosure.

What is claimed is:

1. An ink circulation supply system for an inkjet head, the system being configured to supply ink to the inkjet head having a plurality of nozzles for ejecting the ink, the system comprising:

a meniscus reservoir connected to the inkjet head through a supply passage, and configured to transfer the ink to the inkjet head;

a circulation reservoir connected to the inkjet head through a recovery passage, and configured such that the ink recovered from the inkjet head is returned thereto;

an ante reservoir connected to the circulation reservoir through a first pressure connection pipe connected to an upper portion of the ante reservoir, connected to the meniscus reservoir through a second pressure connection pipe connected to the upper portion of the ante reservoir, connected to the circulation reservoir through a first ink connection pipe connected to a lower portion of the ante reservoir, and connected to the meniscus reservoir through a second ink connection pipe connected to the lower portion of the ante reservoir;

a first pressure controller connected to the meniscus reservoir through a first pressure control pipe, and configured to control internal pressure; and a second pressure controller connected to the circulation reservoir through a second pressure control pipe, and configured to control internal pressure, wherein a first pressure valve is provided in the first pressure connection pipe, a second pressure valve is provided in the second pressure connection pipe, and an ink valve is provided in the second ink connection pipe.

2. The system of claim 1, wherein a flow sensor for measuring a flow rate of the ink is provided in at least one of the supply passage and the recovery passage.

3. The system of claim 1, further comprising:

an ink reservoir tank provided externally and configured to store the ink, wherein the ink is additionally injected into one of the meniscus reservoir, the circulation reservoir, and the ante reservoir through a first injection pipe connected to the ink reservoir tank.

4. The system of claim 1, further comprising:

an ink reservoir tank provided externally and configured to store the ink; and a buffer reservoir configured to temporarily store the ink, wherein the ink is additionally injected into one of the meniscus reservoir, the circulation reservoir, and the ante reservoir through a second injection pipe connected to the buffer reservoir, and the ink is circulated between the buffer reservoir and the ink reservoir tank through two transport pipes connected to the buffer reservoir and the ink reservoir tank at positions therebetween.

5. An ink circulation supply method for an inkjet head, the method being circulating ink in the inkjet head without requiring use of a pump in the system of claim 1, wherein an internal pressure of the circulation reservoir is controlled to be lower than an internal pressure of the meniscus reservoir, whereby the ink stored in the meniscus reservoir is moved to the circulation reservoir via the inkjet head.

6. The method of claim 5, wherein the internal pressure of the circulation reservoir is controlled to be lower than the internal pressure of the meniscus reservoir, and the first pressure valve, the second pressure valve, and the ink valve all remain closed, whereby the ink stored in the meniscus reservoir is moved to the circulation reservoir via the inkjet head.

7. The method of claim 6, wherein the internal pressure of the circulation reservoir is controlled to change a difference between the internal pressure of the meniscus reservoir and the internal pressure of the circulation reservoir, whereby a flow rate at which the ink stored in the meniscus reservoir is moved to the circulation reservoir via the inkjet head is controlled.

8. The method of claim 7, wherein the internal pressure of the circulation reservoir is controlled on the basis of the flow rate measured by the flow sensor provided in the supply passage or the recovery passage.

9. The method of claim 6, wherein when a predetermined amount of the ink stored in the meniscus reservoir is moved to the circulation reservoir via the inkjet head, the first pressure valve is opened, causing an internal pressure of the ante reservoir to match with the internal pressure of the circulation reservoir, and causing the ink stored in the circulation reservoir to be moved to the ante reservoir due to a difference in head pressure between the ink stored in the ante reservoir and the ink stored in the circulation reservoir.

10. The method of claim 9, wherein when a predetermined amount of the ink stored in the circulation reservoir is moved to the ante reservoir, the first pressure valve is closed and the second pressure valve is opened, causing the internal pressure of the ante reservoir to match with the internal pressure of the circulation reservoir; and the ink valve is opened, causing the ink stored in the ante reservoir to be moved to the meniscus reservoir due to a difference in head pressure between the ink stored in the ante reservoir and the ink stored in the meniscus reservoir.

* * * * *